United States Patent [19]

Follstaedt et al.

[11] Patent Number: 5,063,990

[45] Date of Patent: Nov. 12, 1991

[54] METHOD AND APPARATUS FOR IMPROVED MELT FLOW DURING CONTINUOUS STRIP CASTING

[75] Inventors: Donald W. Follstaedt, Middletown; Edward L. King, Trenton; Ken C. Schneider, Dayton, all of Ohio

[73] Assignee: Armco Inc., Middletown, Ohio

[21] Appl. No.: 543,612

[22] Filed: Jun. 22, 1990

[51] Int. Cl.[5] ..... B22D 11/06

[52] U.S. Cl. ..... 164/463; 164/479; 164/429; 164/423

[58] Field of Search ..... 164/463, 423, 429, 479

[56] References Cited

U.S. PATENT DOCUMENTS

| | | | |
|---|---|---|---|
| 4,399,860 | 8/1983 | Johns | 164/423 |
| 4,678,719 | 7/1987 | Johns | 428/593 |
| 4,715,428 | 12/1987 | Johns | 164/463 |
| 4,749,024 | 6/1988 | Bartlett | 164/463 |
| 4,751,957 | 6/1988 | Vaught | 164/463 |
| 4,771,819 | 9/1988 | Toyama | 164/428 |
| 4,819,712 | 4/1989 | Bartlett | 164/463 |
| 4,828,012 | 5/1989 | Honeycutt, III | 164/479 |
| 4,842,040 | 6/1989 | Bibler | 164/429 |
| 4,865,117 | 9/1989 | Bartlett | 164/479 |

OTHER PUBLICATIONS

*Three-Dimensional Modeling of Melt Flow in Tundishes for Strip Casting*–A. K. Sinha, Y. Sahai & R. C. Sussman, presented at International Symposium on Casting of Near Net Shape Products in Honolulu, Hawaii—Nov. 13–17 1988.

*Primary Examiner*—Kuang Y. Lin

*Attorney, Agent, or Firm*—Larry A. Fillnow; Robert J. Bunyard; Robert H. Johnson

[57] ABSTRACT

The continuous casting of metal strip using the melt overflow process is improved by controlling the weir conditions in the nozzle to provide a more uniform flow of molten metal across the width of the nozzle and reducing the tendency for freezing of metal along the interface with refractory surfaces. A weir design having a sloped rear wall and tapered sidewalls and critical gap controls beneath the weir has resulted in the drastic reduction in edge tearing and a significant improvement in strip uniformity. The floor of the container vessel is preferably sloped and the gap between the nozzle and the rotating substrate is critically controlled. The resulting flow patterns observed with the improved casting process have reduced thermal gradients in the bath, contained surface slag and eliminated undesirable solidification near the discharge area by increasing the flow rates at those points.

24 Claims, 5 Drawing Sheets

METHOD AND APPARATUS FOR IMPROVED MELT FLOW DURING CONTINUOUS STRIP CASTING

The Government of the United States of America has right in this invention pursuant Contract No. DE-FC07-88ID12712 awarded by the U.S. Department of Energy.

FIELD OF THE INVENTION

The present invention relates to a system for the continuous casting of thin strip or foil which may be crystalline or amorphous. The system uses a casting method wherein the melt pool is not contained by the casting nozzle on its upper surface and provides an improved flow of molten material from a pool onto a cooled rotating substrate.

BACKGROUND OF THE INVENTION

Continuous casting molten strip requires the critical control of bath conditions if the strip is to be uniform. The temperature of the molten material, the length of pool contact with the rotating substrate, the flow rates within the nozzle, and the bath composition must all be controlled precisely if the cast strip is to be uniform. Any slag on the bath surface must be restrained.

Prior strip casting methods for regulating the flow of molten material have varied widely depending on the casting method. The melt overflow method relies mainly on the height of the molten pool and its proximity to the rotating substrate. The method uses a nozzle which is open at one end and does not contain the top surface of the pool. Weirs, dams or baffles in the pouring box have been used to prevent the flow of slag onto the substrate, control initial filling of the vessel and control the height of the pool. The rotating speed of the substrate and the strip thickness produced will determine the flow rate from the pool.

Baffles have been provided in the center of the pool near the substrate to slow the flow of metal in the middle to approximate the edge conditions where the sidewalls restrict the flow rates. The center of a flowing stream will always flow fastest with uniform conditions because there are fewer obstructions to retard flow.

Another important consideration to develop uniform cast strip is the ability to control turbulence which is related to flow rates and edge conditions. It has been proposed by some that turbulence may help reduce ripples in the bath and some nozzles were sloped downward at the lip to induce turbulence. U.S. Pat. No. 4,819,712 stated that a transverse horizontal bar was placed in the flow path below the melt surface and closely adjacent the casting surface to induce turbulence and help reduce ripples. It was concluded, however, that turbulence was immaterial and the bar was removed.

Another important influence on the cast strip uniformity is the shape of the nozzle adjacent the rotating substrate. U.S. Pat. No. 4,819,712 developed a downwardly sloped or curved lip in the discharge area of the tundish. A great change in flow direction in the meniscus area was thought to minimize ridges in the cast strip.

Slag control is required for uniform composition and strip thickness. As far back as U.S. Pat. No. 2,383,310, people have used a device to control the slag layer during strip casting. However some modern casting systems have used only a contoured tundish lip without weirs or baffles such as U.S. Pat. No. 4,819,712.

Another example of flow control in strip casting is U.S. Pat. No. 4,715,428 which uses partially submerged plates 36 to develop uniform flow. These plates baffle or dampen the flow to obtain uniform flow across the width of the tundish and restrain the flow of surface oxides and slag.

U.S. Pat. No. 4,828,012 argued U.S. Pat. No. 4,715,428 reference did not suggest the use of these plates for the control of channeling and temperature control. The '012 patent used two diverging walls (48 and 50) in combination with a central baffle 46 and a flow restricting dam 52. This combination of diverting and dividing walls created a submerged opening 54 which controlled flow, temperature and strip uniformity. Opening 54, the distance between the floor of the tundish and the bottom of the dam 52, was preferably slightly less than the maximum depth of the liquid metal pool adjacent the casting substrate. The only example was for casting aluminum strip and no details were provided on opening 54.

U.S. Pat. No. 4,865,117 is another melt drag process which shows the use of various weir designs to control the molten metal supply for strip casting. The position of the weirs or dams determines if their function is to control slag on the surface of the bath, provide a source of molten metal or modify the flow of molten metal. The weir closest to the drum may be used to control the melt level and the length of melt contact with the drum. The contact length is very important in the melt drag process to control the strip thickness. The use of a weir positioned near the drum could be used to meter the liquid metal as an orifice but far better control was found to be provided by using a gas knife to control melt thickness. U.S. Pat. No. 4,865,117 uses weir 5 to control the height of the metal bath and the length of contact of the melt with the drum, which is related to strip thickness. Weir 5 may be closely spaced to the drum to act as a metering orifice.

U.S. Pat. No. 4,751,957 shows the use of weirs to provide surge chambers which provide a uniform supply of molten metal for strip casting. The weir may be vertically adjusted to provide a uniform depth for continuous casting. U.S. Pat. No. 4,751,957 shows the use of a weir 72 to meter the flow at a point along the drum where there is no longer a molten pool. In effect, the air knife shown as the invention replaced the prior art weir 72.

Another weir design is represented by World Patent Publication No. 87/02284. A series of weirs are shown which control the flow of molten metal onto a grooved wheel.

U.S. Pat. No. 4,399,860 is a melt drag process which contains the molten metal on one side of a meniscus pool by the rotating substrate or wheel. The wheel drags the melt onto the wheel to form a continuous strand. One of the orifices shown has a fanning arrangement to provide more molten metal at the lateral edge portions to produce strip having improved edge equality. The process has been limited in line speed by the restricted flow conditions along the refractory walls in the pouring nozzle area. This reduces the localized flow rate of molten metal into the meniscus pool area and creates a condition which causes freezing of the molten metal along the refractory surfaces.

The attempts to overcome the flow restrictions with strip casting have included nozzles with enlarged openings at the edges to provide more molten metal at the edges, such as in U.S. Pat. No. 4,399,860. However, this solution does not employ an open pool of metal between the orifice and the wheel. The teachings are related to very thin foil and do not have the flexibility to produce a wide range of product thicknesses and provide a long contact between the meniscus pool and the wheel.

The prior work to control metal flow for the production of thin metal strip has not been completely successful due to the lack of control of metal flow in the pool adjacent the substrate. Prior melt overflow casting systems have suffered from the molten material freezing along the refractory surfaces in the pool discharge area. The quality of the cast strip in terms of uniform gage and surface has not been entirely successful in the past. The present invention has improved the uniformity of composition and thickness. The present invention has overcome the prior casting difficulties and provided a method and means to produce uniform cast strip using the open channel casting process.

SUMMARY OF THE INVENTION

The open channel method for strip casting involves contact between a single cooling wheel or belt and an open melt pool. The melt pool is partially contained between the cooling wheel and the pouring nozzle. A stable meniscus forms between the molten pool and the casting substrate to the extent that there is no melt leakage at the point of initial contact. The melt pool is controlled to provide a more rapid localized flow near the rotating substrate and a higher volume of hot metal along the refractory bottom and sidewall joints than is found in melt overflow casting methods. The present invention does not contain the top surface of the pool with the nozzle and provides a critically controlled weir which drastically changes the casting process from melt overflow. The present invention has minimized freeze-ups and improved the uniformity of strip cast compared to the melt overflow process.

The metal flow is essentially under a very low head condition where the major driving force is the pumping action from the rotating substrate. The molten pool is modified by increasing the localized flow of the hottest metal available to the contact areas with the refractory containment using an improved nozzle-weir design. The localized metal flow rate is increased from previous systems to prevent premature solidification and freezing near the substrate. The pool metal will have a circulation pattern which is attributed to these flow conditions. The system may include a sloped nozzle weir wall in the rear which improves the flow into the casting pool. Further flow improvements result from a tapered sidewall in the casting area adjacent the substrate. The channel under the nozzle weir in the casting pool must be controlled to provide the desired clearance with the bottom of the nozzle. Optimum conditions are provided when the gap under the nozzle weir is increased at the edges to provide larger volumes of hot metal along the bottom and in the corners of the nozzle and more rapid local flow rates of hot metal in the areas where freeze-ups along the refractory surfaces are most likely to occur.

It is a principal object of the present invention to provide a system which produces a uniform cast strip in a wide range of the thicknesses and widths. It is also an object of the present invention to provide a system which improves the localized flow of molten metal into the pool by controlling the slopes of the nozzle weir and nozzle walls in combination with the gap beneath the nozzle weir.

Another object of the present invention is to improve the circulation of molten metal in the nozzle to reduce thermal gradients and improve the uniformity of composition while containing the upper slag level.

A still further object of the present invention is to provide the hottest molten metal possible to the pouring nozzle adjacent the substrate to drastically reduce the rate of freeze-ups. The volume and flow rates of hot metal into these potential freeze areas will be increased.

Other objects and advantages of the present invention will become apparent from the following detailed description of the preferred embodiments and related drawings.

DETAILED DESCRIPTION OF THE PREFERRED EMBODIMENTS

The present invention may be used for strip or foil casting with an open channel melt casting system. The composition of the bath is not a limitation of the invention and may include such materials as stainless steels, low carbon steels, silicon steels, aluminum, amorphous metals and other metals and alloys. The thickness of the cast strip is not a limitation of the process but is normally about 0.001 to 0.2 inches (0.025 to 5 mm) and usually less than 0.1 inches (2.5 mm). The subsequent use of the terms metal bath or metal strip is not a limitation on the scope of the invention.

The rapid solidification process of open channel casting involves bringing a molten pool having a free surface into contact with a cooled rotating wheel or belt to form the cast strip or foil. The rotating substrate acts to contain the molten pool as well as remove the metal from the pool. The substrate is rotated at a speed of 50 to 5,000 feet per minute (about 15 to 1500 meters per minute). The total flow rate of molten material onto the substrate is determined by the dragging force of the wheel which depends on the wheel speed and surface of the substrate.

Figure 1:
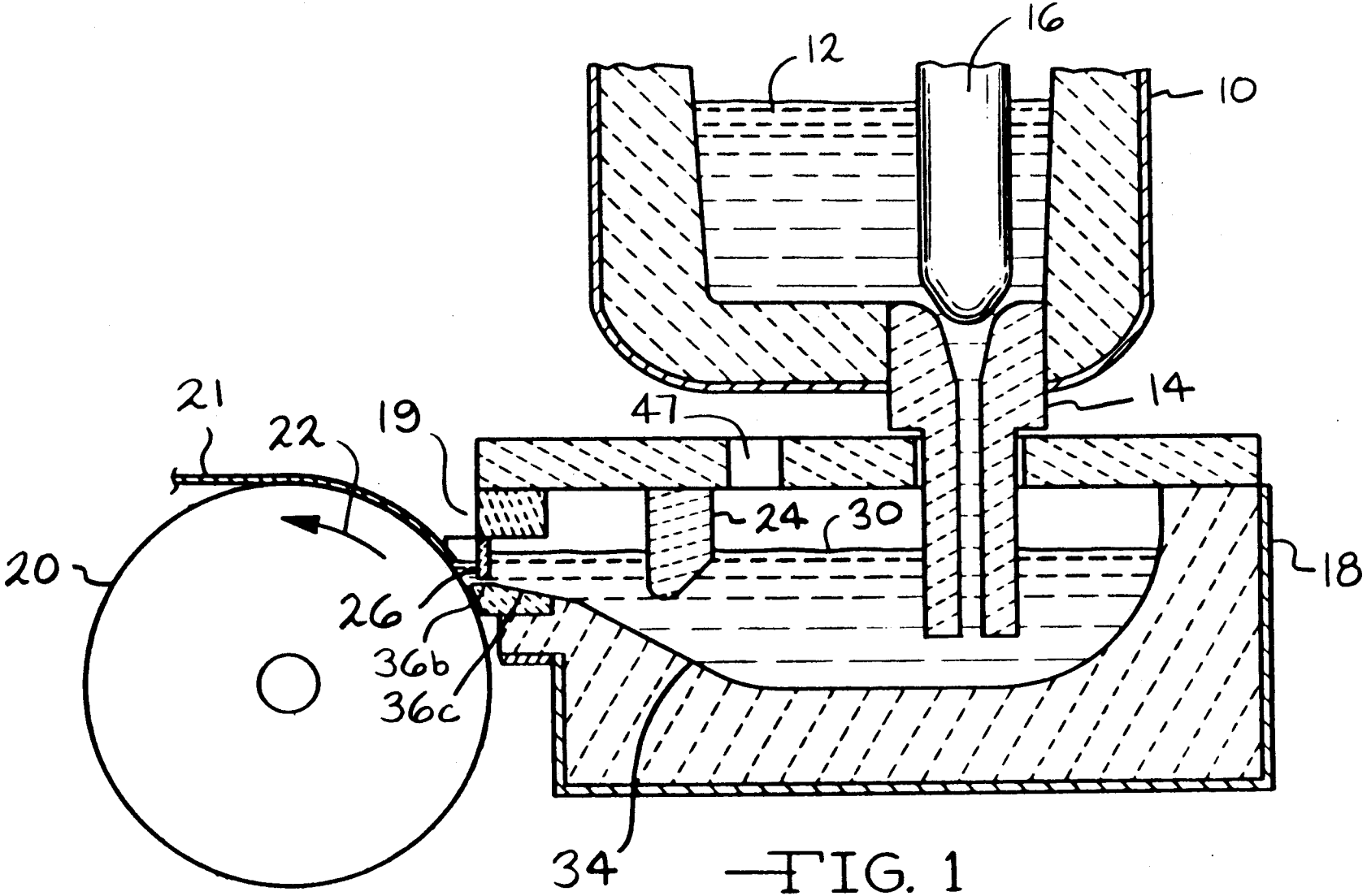
FIG. 1 is a diagrammatic side sectional view of an apparatus according to the present invention.

A basic casting system is shown in FIG. 1 which shows a refractory lined vessel 10 which supplies molten metal 12 through a supply nozzle 14 which is regulated by a stopper rod 16. A container vessel 18 holds the molten metal for supplying molten metal to the casting nozzle 19. Casting nozzle 19 has an outer surface which conforms to the shape of the substrate. The casting nozzle 19 may be a separate element connected to the container vessel 18 or may be monolithic and integrally formed with the container vessel. Casting wheel 20 contains the molten metal on one side and rotates in direction 22. While a wheel 20 is shown, other rotating substrates, such as a belt or drum, may also be used. The container vessel 18 may have one or more flow control devices such as a dam or weir. A container vessel weir 24 is shown which is used to contain slag on the surface of the molten metal in the container vessel. Other weirs or dams, not shown, could be used to prevent splashing and provide start-up control while the container vessel is being initially filled prior to casting strip. Weirs may also be used to regulate the volume of metal available for providing the desired flow rates for casting.

Figure 2:
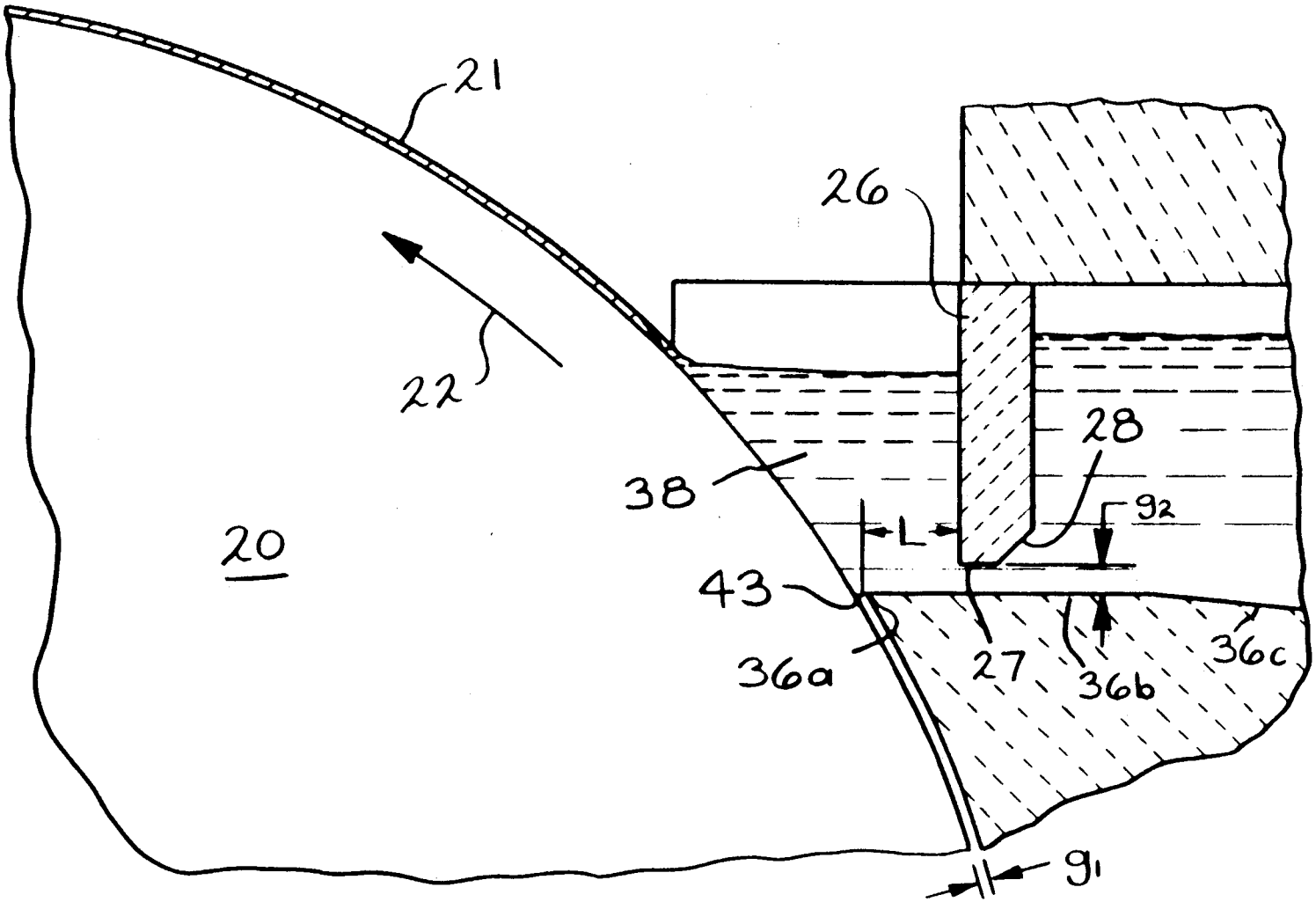
FIG. 2 is an enlarged diagrammatic side sectional view of the casting weir and nozzle of FIG. 1.

As best seen in FIG. 2, the casting weir 26 is located in the casting nozzle 19 and is used to channel the flow of molten metal towards the wheel 20. The weir 26 provides a reduced gap $g_2$ below the nose portion 27 of the casting weir to increase the rate of molten metal flow. The flow rate depends on the static pressure head created between the pouring box bath height and the casting pool. This pressure differential may be increased by pressurizing the pouring box to further increase the flow rate into the casting nozzle 19. An opening 47 may be provided in the roof of the container vessel 18 for pressurizing the melt supply or providing a protective atmosphere for the melt for oxidation control. If the supply of molten metal in vessel 10 is continuous with the pouring box bath, the static differential may be further increased. The supply nozzle 14 may be sealed with the pouring box and a roof provided to increase the molten metal feed pressure, provide a protective atmosphere which minimizes slag formation and help to prevent loss of the molten metal temperature.

Weir 26 may have a rectangular rear wall 28 or be sloped at any angle up to 90° to improve the metal flow passing under the nose portion 27. The weir wall 28 is preferably sloped from 15° to 75° and more preferably from 30° to 60°. A taper of 45° has been found to provide a good balance between increased flow rates and resistance to wear and breakage. Preferably the wall is sloped at a point below the slag level 30 to further increase the rate of flow below the casting weir 26. The increased flow into the open channel pool 38 is shown in FIG. 2 based on the difference in metal level between the metal supply level and the channel level and indicates the process is entirely different from melt overflow which has the same metal levels. The weir sides 29 will be shaped to the configuration of the sidewalls of the casting nozzle 19 and are usually tapered upwardly to minimize wall contact restriction for better metal flow. The taper, if present, will typically range from 80° to 90° but could be any angle up to 90°. The height of casting weir 26 and container weir 24 depend on the depth of the metal being restrained. Weir 26 is adjusted in length to provide a gap $g_2$ under nose portion 27 to produce a high rate of localized flow into the casting nozzle 19. A typical central gap $g_2$ of about 0.05 to 0.75 inches (about 12.5 to about 190 mm) below the weir is used with a nozzle to substrate gap $g_1$ of about 0.001 to 0.03 inches (0.025 to 0.75 mm). The minimum distance is one which avoids contact with the substrate and the maximum is determined by the melt composition and casting conditions which avoids leakage at the edge of the nozzle. The smaller gap below the casting weir is one of the key differences which has improved the casting process of the present invention. The weir nose portion 27 may be rounded, flat or inclined and may have a length which varies from a knife edge up to about 2 inches (5 cm). Depending on the choice of refractory and nose design, the weir will vary in terms of wear and flow rates produced.

Figure 4A:
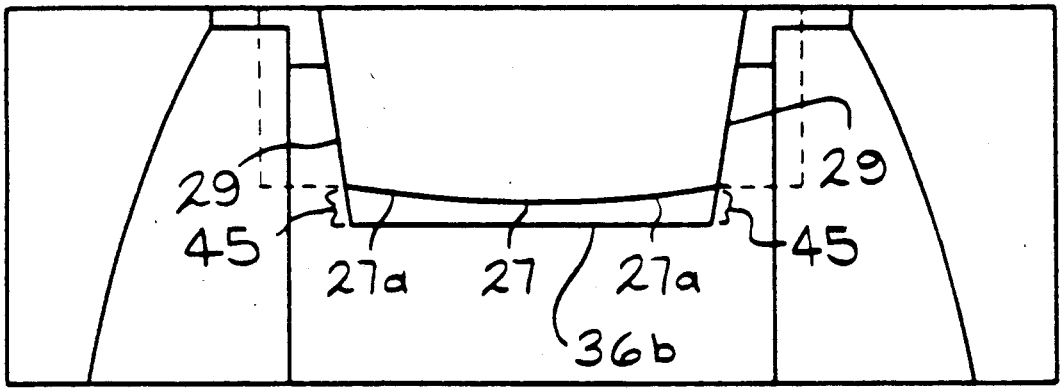
FIGS. 4*a*, 4*b* and 4*c* are front elevational views of modified casting weirs for increased flow of hot metal along the edges of a pouring nozzle.
Figure 4B:
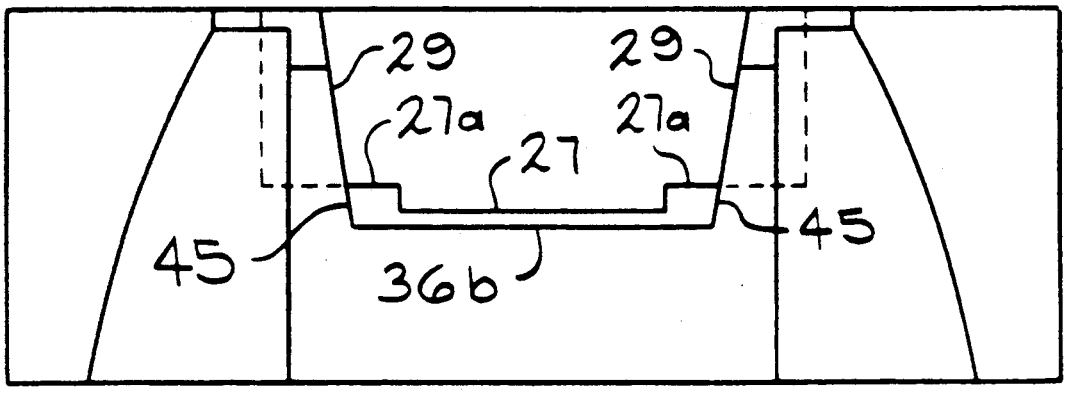
Figure 4C:
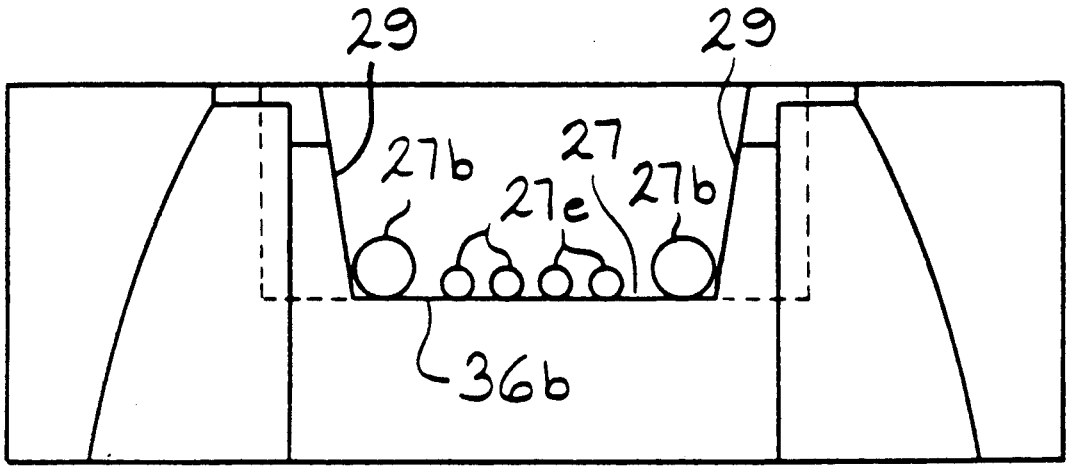

The pouring box 18 may have a cover which helps to minimize oxidation of the molten material if a protective atmosphere is provided. The means to provide the protective atmosphere for slag control or increased localized flow are not shown but are easily provided by those skilled in the casting art. The bottom of the pouring box has a floor which may be sloped upwardly at an angle of 30° to 60° identified as 34 which normally makes a smooth transition into the nozzle floor 36. Floors 34 and 36 may be level or sloped upwardly or downwardly towards the rotating substrate or wheel 20. The nozzle floor 36 has an edge 36*a* which is the portion of the floor closest to the substrate 20. The nozzle floor 36 has an exit portion 36*b* which is beneath the weir 26. Nozzle floor 36*b* is generally horizontal but may have a slight upward or downward incline. Nozzle floor 36 may also have a second portion 36*c* which connects with the pouring box floor to make a smooth transition for optimum flow conditions. In some situations as indicated in FIGS. 4*a*, 4*b* and 4*c*, the nozzle floor may have only a single floor configuration. The molten metal flow is more turbulent in the casting pool area 38 and provides a better mixing of the bath for improved temperature and composition. The laminar flow patterns of prior systems have suffered stratification problems in this casting pool area. The volume and velocity of the molten metal supplied to the casting pool must be balanced to the amount withdrawn onto the substrate during casting. The total flow of melt does not change from the nozzle of the present invention since this level is determined by the substrate conditions. The present invention modifies the local flow rate and volume along the nozzle floor and refractory corners. Sufficient heat extraction from the wheel must be provided to prevent partially molten strip exiting the substrate prematurely. The improved flow of the casting metal is partially attributable to the reduction in crossover currents and pinching at the sides which produces a smooth consistent flow onto the substrate. The turbulent behavior in the casting pool is partially related to the control of the wheel to casting weir distance L and the strong flow patterns shown in FIG. 5 which follow the wheel for a while and then completes a circular flow towards the pool surface and down the front face of the weir wall.

The casting nozzle of the present invention will provide a controlled distance L from the front face of the weir 26 to the wheel 20. A distance of about 0.25 to about 2 inches (about 6 to 50 mm) has been found to be very effective with the gaps previously discussed beneath the weir and to the substrate from the nozzle.

Figure 3:
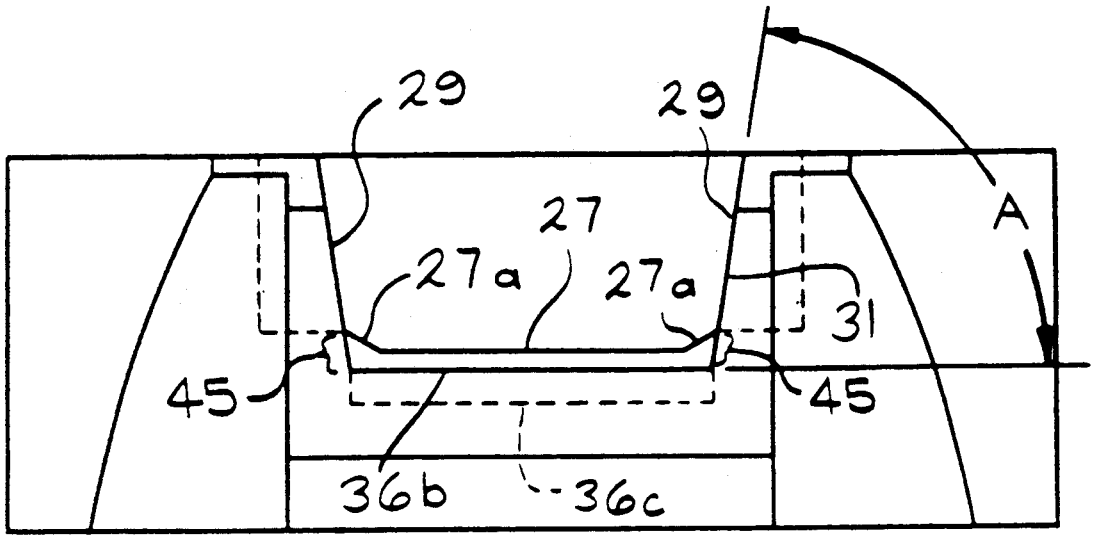
FIG. 3 is a front elevational view of the casting weir and nozzle shown in FIG. 2.
Figure 3A:
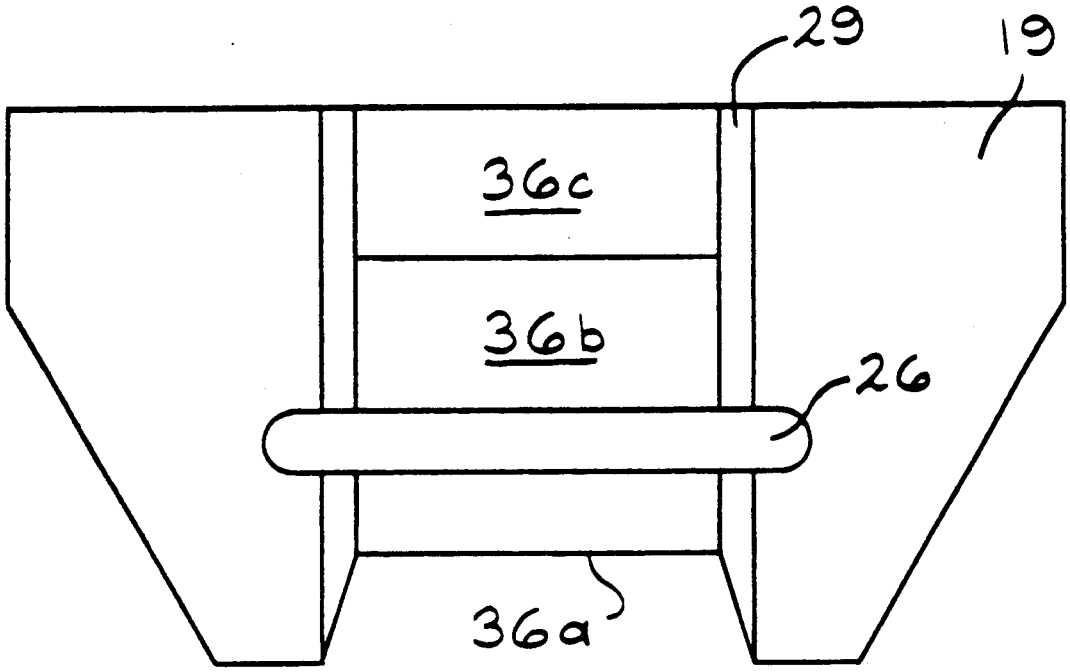
FIG. 3*a* is a top view of the casting nozzle and weir of FIG. 3.

The casting system of the present invention has an improved localized flow of metal as a result of sidewall taper and bottom clearance of the weir as shown in FIG. 2, FIG. 3 and FIG. 3*a*. The bottom of weir 26 is identified as nose 27 in FIG. 2 and has two tapered edges identified as 29. The tapered openings of the weir edges may vary up to 90° and are typically from about 80° to 90°. The edge taper will reduce the restriction of metal flow to provide an improved flow across the entire width of the casting nozzle and reduce freezing of the melt at the refractory points which retard flow. The weir edges 27*a* are tapered to increase the localized flow along the refractory surfaces. The weir portions 27*a* have a gap $g_2$ which is larger than gap beneath the central portion of the weir 27. Preferably the minimum increase in gap $g_2$ at 27*a* is at least 15% and more preferably at least 25%. The greatest increase in localized flow rates and volumes are produced when the differences are at least 50%.

The front view of the casting system shown in FIG. 2 illustrates the general clearance condition between the weir nose portion 27 and the floor of the casting nozzle. The inclined floor 36 has an front portion 36*a* at the point near the substrate and a rear portion 36*b*. The vertical sidewalls of the casting nozzle are identified as 31 may be tapered at any angle up to 90° and are typically about 80° to 90°. The gap $g_2$ between the nose portion 27 and the upper floor surface 36*b* may be zero as shown in FIG. 4*c*. A preferred central gap range for $g_2$ is about 0.125–0.5 inches (about 30–120 mm). The amount of opening is dependent upon the desired strip thickness and substrate speed. The upper opening at the edges 27*a* will normally be about twice the opening at the center portion 27 and will be about 5–10% of the total weir width.

The turbulent flow of molten metal in the present invention provides the improved conditions for strip casting. The flow helps eliminate solidification near the substrate and provides a higher melt temperature at the casting meniscus. Turbulence is directly related to the reduced cross section area in the converging region. The flow control system of the present invention will also be of assistance in controlling the initial surge of molten metal at the start of metal casting.

FIGS. 4*a*, 4*b* and 4*c* illustrate other design possibilities with the present invention to modify the flow rates locally. All of these versions will provide increased volume and flow locally along the refractory portions which restrict flow. In the case of FIG. 4*c*, the weir actually contacts the floor of the nozzle and all of the melt passes through the corner orifices 27*b* and smaller central orifices 27*e*. In FIG. 4*b*, the corner openings 27*a* are increased in dimension compared to the gap below weir 27 and shaped more dramatically in the corners compared to the gradual increase in opening dimension for openings 27*a* shown in FIG. 4*a*.

Figure 5:
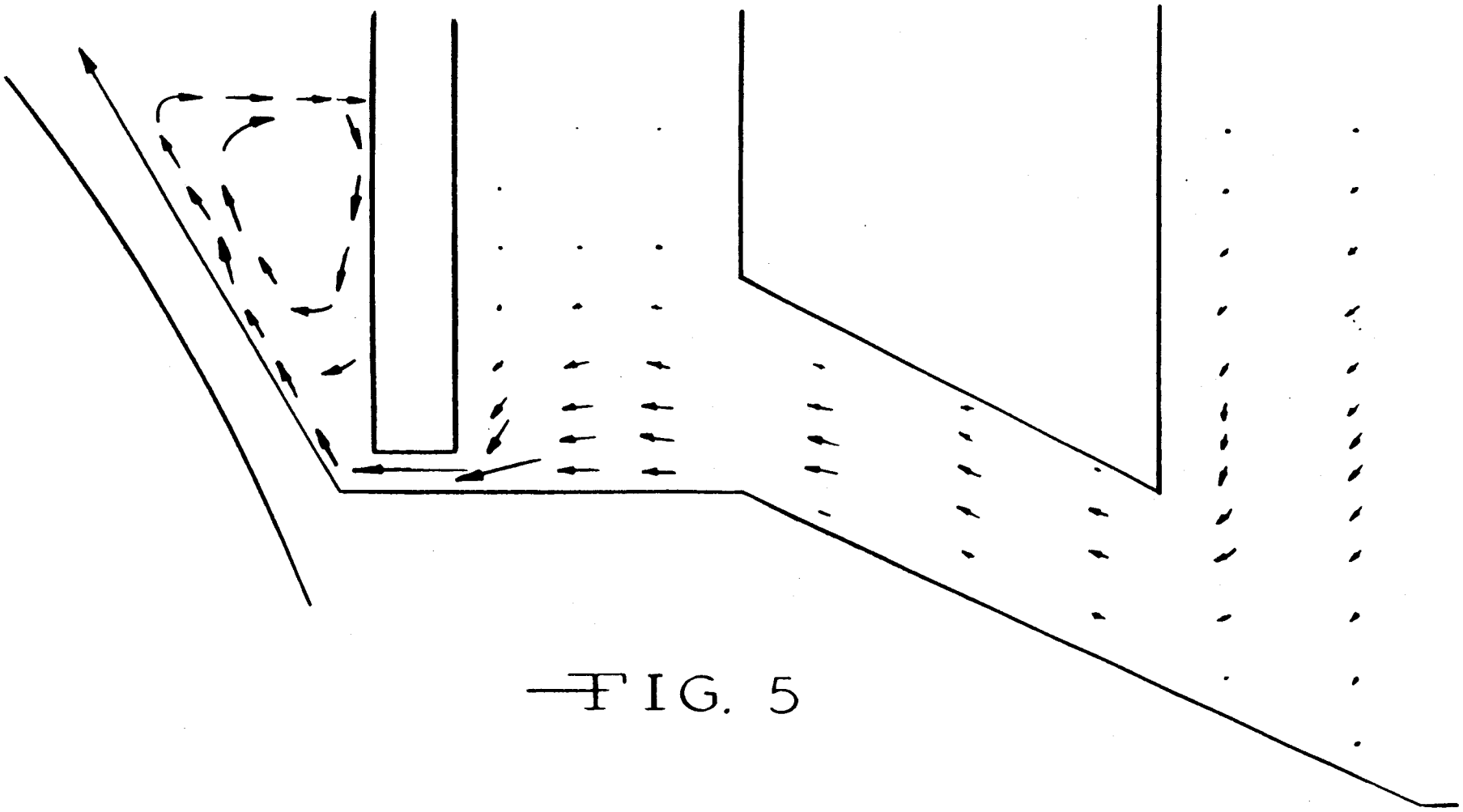
FIG. 5 is flow diagram of the process of the present invention using a mathematical model to illustrate the increased rate of molten metal flow into the casting pool.

FIG. 5 shows the turbulent flow patterns produced with the pouring box and weir design of the present invention developed by mathematical modeling. The increased velocities produced by this design are represented by arrows having longer lengths. The present design has also controlled slag and produced a casting process which may be used at high rates of speed and produces a very uniform cast strip. The length to depth ratio of the pool prior to casting has also been demonstrated to show its influence on the casting flow patterns.

FIG. 5 represents the flow rates in a strip casting melt overflow system having the improved flow characteristics produced from the weir design of the present invention. A computer generated flow diagram with the length of the arrows corresponding to the localized velocities was approximated by FIG. 5. The weir design and the position of the weir increased the localized flow rate along the bottom and corners of the nozzle. The increased localized flow rates increased the temperature of the molten material along the refractory surfaces and reduced the potential for metal freezing along these surfaces. The increased localized flow (velocity and volume) have considerably reduced the build-up of solidified metal deposits and nonuniform temperature and composition conditions.

The present invention is now explained with reference to the following examples.

EXAMPLE 1

Silicon killed low carbon steel having a composition of about 0.05% C, 0.35% Mn, 0.17% Si, and balance essentially iron was cast at about 2850° F. (about 1565° C.) onto a 16 inch (40 cm) diameter copper wheel at a position about 60° before top dead center. The casting nozzle was set at a gap $g_1$ of about 0.03 inches (about 0.75 mm) and the rotational speed of the wheel was varied between about 710–800 feet per minute (about 215–250 meters per minute). A fused silica refractory system was used for the pouring box and weir material. The weir was located about 1.5 inches (3.75 cm) from the edge of the nozzle and had a gap opening at the edges of 0.5 inches (1.25 cm) and a general gap of 0.25 inches (0.6 cm) between the weir and the floor at the central portion of the nozzle. Each edge portion was 0.25 inches (0.6 cm) in length and the central portion of the weir was 2 inches (5 cm) in length. The side walls of the nozzle at the casting end were square. The strip was cast to a thickness of about 0.02 inches (0.5 mm). The results of the trial indicated that freezing could be prevented with a 1 inch (2.5 cm) open channel pool by using a weir with a small central gap and increased edge gaps to increase the localized flow along the refractory surfaces. The strip produced was of good uniform quality.

EXAMPLE 2

The same casting system was used for casting another heat of low carbon silicon killed steel except the gap under the central portion of the weir was reduced to about 0.125 inches (about 0.3 cm) and the edge portions tapered to a gap 0.25 inches (about 0.6 cm) which was about half of the previous example. The level of molten steel in the open channel was maintained at about 0.75 inches (about 1.9 cm). As a result of these changes, the same gage strip had excellent quality.

EXAMPLE 3

The casting system was modified to provide a central weir gap distance of about 0.19 inches (about 0.5 cm) and a tapered gap at the edges of about 0.75 inches (about 1.9 cm) with an edge width of about 0.19 inches (about 0.5 cm). With this configuration, it was observed that the 0.024 inch (about 0.6 mm) strip could be cast at substrate speeds down to 550 feet per minute (170 meters per minute) without freezing with an open channel depth of about 0.5 inches (about 1.2 cm).

The prior problems with variable edge conditions and poor surface quality have been greatly reduced by the improved flow of molten metal during strip casting with the open channel process of the present invention. By controlling the gaps beneath the weir across the weir width, providing tapered weir sidewalls, a tapered weir rear wall and the proper weir and nozzle distances to the substrate, an open channel casting system has been developed which provides optimum localized flow conditions, improved strip quality and far less tendency for freezing.

Whereas the preferred embodiment has been described above for the purpose of illustration. it will be apparent to those skilled in the art that numerous modifications may be made without departing from the spirit of the invention. The invention is therefore not limited by these specific embodiments but only to the extent set forth hereafter in the claims which follow.

We claim:

1. A method of open channel strip casting molten material through a casting nozzle onto a rotating substrate with reduced freezing of the molten material along refractory surfaces of said casting nozzle and for providing improved uniform molten material flow onto said substrate, said method comprising the steps of:

a) providing a container vessel having a refractory floor and refractory sidewalls for holding said molten material;

b) providing a casting nozzle having refractory walls connected to said container vessel;

c) providing a cooled rotating substrate which is spaced from nozzle sufficiently far to insure said nozzle does not contact said substrate and close enough to said nozzle to insure the molten material does not leak between said nozzle and said substrate;

d) providing a nozzle casting weir which is positioned about 0.25 to about 2 inches (about 6 to about 50 mm) from said substrate, said weir having a bottom central gap between said weir and said nozzle floor up to about 0.75 inches (about 20 mm) and bottom weir edges tapered to increase the gaps at said edges to provide an increased localized flow of molten material along said nozzle refractory walls to increase the volume of localized hot material to reduce sticking and provide a more uniform casting flow across the width of said nozzle.

2. The method of claim 1 wherein said container vessel has a flat refractory bottom floor.

3. The method of claim 1 wherein said container vessel has a refractory floor sloped upwardly towards said substrate at an angle of about 30° to 60°.

4. The method of claim 1 wherein said weir edge gap is about at least 15% more than said central gap opening.

5. The method of claim 1 wherein said central weir portion is 90 to 95% of the total weir width.

6. The method of claim 1 wherein said rear wall of said weir is tapered.

7. The method of claim 1 wherein said sidewalls of said weir and nozzle are tapered.

8. The method of claim 6 wherein said rear wall taper is from 15° to 75°.

9. The method of claim 7 wherein said sidewall taper is from 80° to 90°.

10. The method of claim 1 wherein said casting material is a ferrous material.

11. The method of claim 1 wherein said substrate is rotated at a speed of 50 to 5,000 feet per minute (about 15 to 1500 meters per minute) and said cast strip is about 0.001 to 0.1 inches (0.025 to 2.5 mm) thick.

12. The method of claim 1 wherein said casting flow is pressurized to further increase the flow rates by providing said container vessel with a cover having an opening through which a pressurizing gas is introduced.

13. An apparatus for open channel strip casting comprising:

a) a container vessel for storing molten material;

b) a cooled rotating substrate;

c) a refractory nozzle connected to said container vessel and positioned about 0.001 to about 0.03 inches (about 0.025 to about 0.75 mm) from said substrate, said nozzle having an outer surface conforming to the shape of said substrate; and d) a weir positioned within said nozzle at about 0.25 to about 2 inches (about 6 to about 50 mm) from said substrate and spaced about 0.05 to 0.75 inches (about 1 to about 19 mm) above the nozzle floor in the central portion and spaced at least about 15% further from the floor at the edges of said weir.

14. The apparatus of claim 13 wherein said weir has a tapered rear wall.

15. The apparatus of claim 14 wherein said rear taper is from 15° to 75°.

16. The apparatus of claim 13 wherein said weir has tapered sidewalls.

17. The apparatus of claim 16 wherein said taper is from 80° to 90°.

18. The apparatus of claim 13 wherein said nozzle has a sloped floor.

19. The apparatus of claim 13 wherein the edges of said weir have a gap above said nozzle floor which is at least 25% larger than at said central portion of said weir.

20. The apparatus of claim 13 wherein said central portion of said weir is at least 90% of said total length.

21. The apparatus of claim 13 wherein a container vessel weir is provided in said container vessel to control slag and improve the flow of molten metal into the container vessel.

22. The apparatus of claim 13 wherein additional pressurizing means are provided to increase the flow of molten metal through the nozzle.

23. The apparatus of claim 21 wherein a roof is provided with said container vessel to pressurize said molten metal flow.

24. The apparatus of claim 14 wherein said weir rear wall is tapered at an angle of 30° to 60°.

* * * * *